United States Patent [19]

Lickert

[11] 4,382,306

[45] May 10, 1983

[54] PRENATAL MATTRESS

[76] Inventor: Jodey J. Lickert, 4632 Harford Rd., Toledo, Ohio 43612

[21] Appl. No.: 303,536

[22] Filed: Sep. 18, 1981

[51] Int. Cl.[3] ..... A47C 27/08; A47G 9/00

[52] U.S. Cl. ..... 5/465; 5/441; 5/449; 5/462

[58] Field of Search ..... 5/465, 462, 448, 437, 5/441, 431, 436, 449–451

[56] References Cited

U.S. PATENT DOCUMENTS

| | | | |
|---|---|---|---|
| 1,548,728 | 8/1925 | Milam | 5/465 |
| 3,378,862 | 4/1968 | Skinner | 5/462 |
| 4,054,960 | 10/1977 | Pettit et al. | 5/462 |

FOREIGN PATENT DOCUMENTS

| | | | |
|---|---|---|---|
| 258077 | 9/1926 | United Kingdom | 5/441 |

*Primary Examiner*—Alexander Grosz
*Attorney, Agent, or Firm*—James L. Wilcox

[57] ABSTRACT

A prenatal mattress enabling a pregnant woman to lie more comfortably and safely upon her abdomen during the pregnancy term is disclosed. The mattress can comprise a lower layer of cloth carrying releasable fasteners, an abdominal cushion, a head cushion, and an upper layer of cloth. The abdominal and head cushions are disposed in appropriate locations between the lower and upper layers to support the respective portions of the body of a particular user. The cushions can be fillable to an extent desired with a suitable fluid, and can be placed between the sheets of cloth and attached to the fasteners carried by the lower layer by means of coordinating fasteners carried on lower surfaces of each. In use, the pregnant woman lies frontally downwardly upon the mattress, her abdomen and head being placed upon their respective cushions.

8 Claims, 3 Drawing Figures

PRENATAL MATTRESS

BACKGROUND OF THE INVENTION

This invention relates to apparatus for providing physical comfort and safety during human pregnancy, and more particularly relates to a mattress which enables a pregnant woman to lie frontally downwardly on her abdomen throughout the prenatal period with a minimum of discomfort and a maximum of safety. Heretofore, it has generally been thought to be necessary to minimize, during the prenatal period, the amount of time pregnant women rest in such a position, where their distended abdomens are forced against a relatively non-compliant surface, for example that of a conventional mattress. Both the safety of the fetus and the comfort of the woman may be compromised when she is forced to lie in such a position, particularly for extended periods of tme during the latter stages of pregnancy. Accordingly, a need has arisen for a simply constructed, economical mattress upon which an expectant mother can lie in a frontally-downward position for a desired length of time without suffering excessive physical discomfort or causing injury to the fetus.

SUMMARY OF THE INVENTION

The instant invention provides a mattress upon which a pregnant woman can lie in a frontally-downward position, and provides the advantages of a maximum of comfort for the user while minimizing the possibility of the fetus being crushed between a comparatively non-compliant surface and the body of the user. Such a mattress according to the invention can comprise:

(a) An upper layer comprising a longitudinally-extending sheet of flexible material having substantially planar upper and lower surfaces and opposed ends;

(b) A lower layer comprising a longitudinally-extending sheet of flexible material having substantially planar upper and lower surfaces and opposed ends, the lower layer being securely attached to the upper layer along a portion of the edges and one end of each of the layers;

(c) A first substantially ring-shaped, resilient cushion, having a substantially circular center hole and disposed between the first and second layers at a suitable location for providing support for the abdomen of the user;

(d) A second resilient cushion, disposed between the first and second layers, and located in a substantially horizontal plane axially of the first cushion in a suitable location for providing support for the head of the user;

(e) Releasable fastening means carried by a portion of the lower surface of the upper layer along adjacent edges thereof;

(f) Releasable fastening means carried by a portion of the upper surface of the lower layer along adjacent edges thereof and located so as to be operable to releasably engage the fastening means carried by the upper layer when the lower surface of the upper layer is brought into contact with the upper surface of the lower layer, thereby to join the layers, the cushions being disposed between the joined layers;

(g) Additional releasable fastening means carried by the upper surface of the lower layer; and (h) Releasable fastening means carried by each of the cushions and operable to releasably engage the additional fastening means carried by the lower layer, thereby to secure the cushions between the layers in their respective suitable locations.

Preferably, each of the cushions is fluid-fillable, and, in use, contains a fluid, for example air or water. Desirably, the releasable fastening means are hook-and-loop fasteners and the material of the upper and lower layers is made of absorbent cotton.

Accordingly, it is an object of the instant invention to provide a prenatal mattress having the advantages described above.

Other objects and advantages of the invention will be apparent from the description which follows, reference being made to the accompanying drawings. The description is intended only to illustrate and disclose, but in no way to limit the invention as defined in the claims appended hereto.

DETAILED DESCRIPTION OF THE INVENTION

Figure 1:
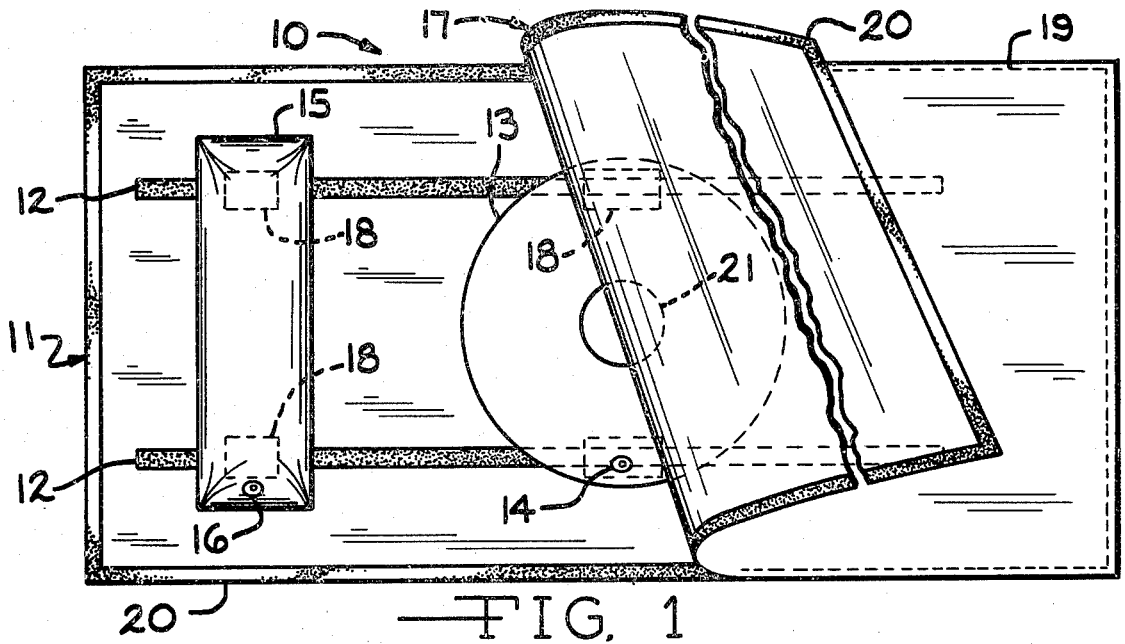
FIG. 1 is a top plan view of a prenatal mattress according to the invention, with a top layer thereof partially folded back to show details of construction.

With reference first to FIG. 1 of the drawings, a preferred embodiment of a prenatal mattress according to the invention is indicated generally at 10. The mattress 10 comprises a rectangular, lower layer of cloth 11 made of moisture-absorbent cotton. The lower layer 11 carries two elongated hook-and-loop fastening strips 12 mounted thereupon which are sold under the trademark VELCRO®, and upon which a cushion 13, which is a hollow, resilient, substantially ring-shaped rubber ring having a circular center hole 21 extending therethrough, is disposed. The cushion 13 can be filled with a suitable fluid, for example water, through a conventional valve 14; a second hollow, resilient and substantially rectangular rubber cushion 15, which also can be filled with a suitable fluid through a conventional valve 16, is disposed upon the VELCRO® strips 12. A rectangular, upper layer of cloth 17 is situated so as to cover upper surfaces of the cushion 13 and 15 and is also made of absorbent cotton.

Figure 2:
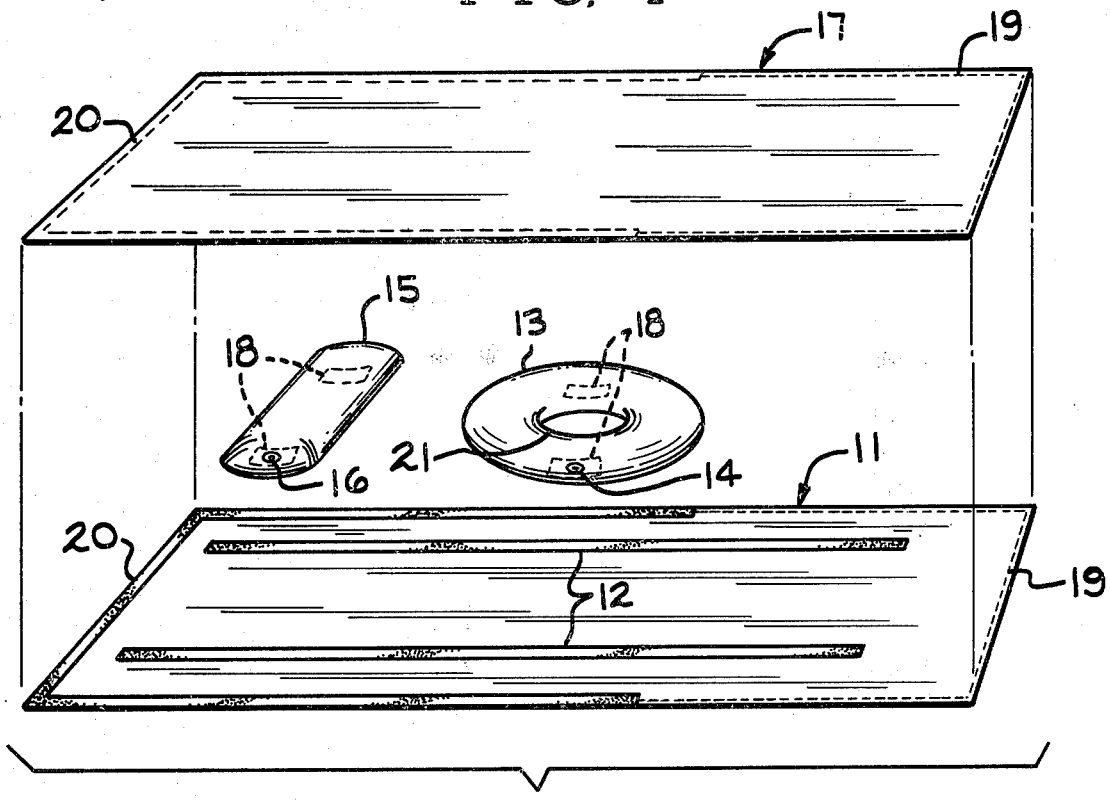
FIG. 2 is an exploded perspective view of the prenatal mattress shown in FIG. 1.

As illustrated in FIGS. 1 and 2, the cushions 13 and 15 are each disposed upon the VELCRO® strips 12 between the lower cloth layer 11 and the upper cloth layer 17, and are held releasably engaged to the VELCRO® strips 12 mounted upon the lower layer 11 by means of suitably-located VELCRO® fasteners 18 affixed to a lower surface of each of the cushions 13 and 15, in positions which coordinate with the location and spacing of the strips 12. Peripheral edges of the layers 11 and 17 are partially sewn together along approximately one-third of their lengths and along adjacent ends, as indicated at 19. Coordinating VELCRO® fasteners are carried by the remaining edges of the layers 11 and 17, as indicated at 20, so that the layers 11 and 17 are releasably joinable along these edges when the mattress 10 is fully assembled.

To use the prenatal mattress 10, a user, typically a pregnant woman, will fill the cushion 13 with a suitable fluid through the valve 14. Such a fluid can be, for example, water, air, or any relatively inert and non-toxic liquid or non-combustible, non-toxic gas. The cushion 15 will be similarly filled with a suitable fluid, through the valve 16. Both of the cushions 13 and 15 will be thus filled to an extent necessary; for example, up to a point where the walls thereof become slightly distended by overfill, to provide a desired degree of compliancy to the body of the user. The user will then place the filled cushions 13 and 15 between the partially separated lower and upper layers 11 and 17, observing care in aligning the VELCRO ® fasteners 18 affixed to the lower surfaces of each cushion with the coordinating VELCRO ® strips 12 on the lower layer 11, so that the cushions are suitably positioned for support of the body weight of the user; the cushion 13 in a position for cushioning and conforming to the contours of the abdomen of the user when the abdomen is placed into the center hole 21, and the cushion 15 in a similar position for cushioning the head of the user.

The cushions 13 and 15 thus will be spaced apart from one another as necessary on the strips 12, preferably disposed in those positions in which the distance between their geometrical centers corresponds approximately to the distance between the center of the head and the center of the abdomen of the user, and then will be secured, by contact of the coordinating VELCRO ® fasteners 18 and 12, in the appropriate positions. The fasteners 20 carried by the layers 11 and 17 will then be brought into contact and the layers 11 and 17 thus secured together to complete assembly of the mattress 10.

Figure 3:
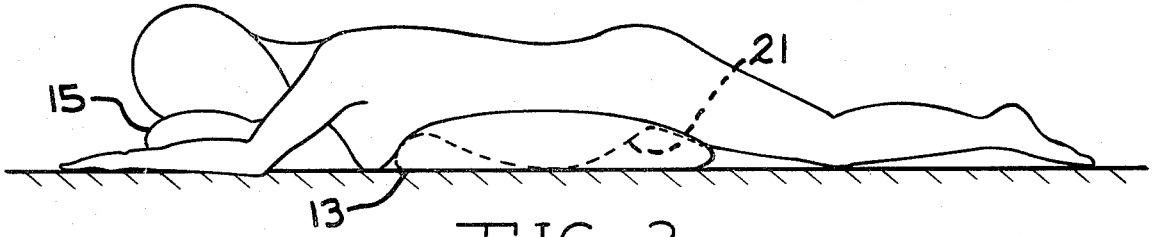
FIG. 3 is a side view of the mattress shown in FIGS. 1 and 2, and further showing a typical pregnant woman lying thereupon.

FIG. 3 illustrates how a pregnant user will lie in a frontally-downward position on a prenatal mattress according to the instant invention, placing her distended abdomen in a position centered generally within the center hole 21 (shown by hidden line) of the abdominal cushion 13, and placing her head on the head cushion 15. Both of the cushions 13 and 15 will be filled with fluid to an appropriate level, to provide a desired degree of comfort; as shown, the cushions 13 and 15 respond compliantly to the weight of the body of the user when so resting thereupon.

It will be appreciated that, during use of the prenatal mattress 10, each component thereof will contribute to enable, in combination, its overall usefulness and effectiveness in providing a pregnant woman with greater comfort and safety while lying upon the mattress, frontally downwardly upon her abdomen. For example:

1. The lower layer 11 provides a surface for attachment of the fastener strips 12 so that the cushions 13 and 15 can be placed in appropriate locations, and further provides a protective covering for lower surfaces of the cushions 13 and 15. Additionally, when made from absorbent cloth, the lower layer 11 can provide moisture absorption during use.
2. The elongated fastening strips 12 provide means for releasably disposing the cushions 13 and 15 in appropriate locations between the lower and upper layers 11 and 17, and enable adjustment of the cushions 13 and 15 along the length of the strips 12 to suitable locations corresponding to the physical proportions of any particular individual user.
3. When the mattress 10 is in use, a fluid-filled cushion 13, being resilient and substantially ring-shaped, enables a pregnant user to rest comfortably by allowing her distended abdomen to fit generally within the center hole 21, even when the cushion 13 is filled only minimally with a fluid. Alternatively, the cushion 13 can be formed of any suitable resilient material, for example foam rubber. Whatever material is used to form the cushion 13, if a major proportion of the weight of both the abdomen and the remainder of the body of the user are appropriately placed near the geometrical center of the cushion 13, the fluid or resilient material will be forced outwardly, thereby slightly distending the outer walls of the cushion 13 and raising slightly areas of the body of the user adjacent to the abdomen, such as the upper thigh area, the rib area and the hip area. The cushion 13 therefore is able to conform to the contours of the distended abdomen, alleviating pressure thereon which might otherwise result from the abdomen being forced against a relatively non-compliant surface, such as that of a conventional mattress—which could result not only in discomfort to the user, but also injury to the fetus. When fillable with a fluid, the cushion 13 can also be adjusted to progressive growth of the abdomen during the pregnancy term merely by varying the volume of fluid used therein. For example, a substantially circular, rubber ring such as a conventional inner tube, can be used to form the cushion 13. Such a tube typically has, for example, a nominal outside diameter of twenty inches, a center hole nominally eight inches in diameter and a total fluid capacity of about ten quarts of water, total capacity being the maximum which will not noticeably distend the walls of the tube. In this case, the cushion—preferably should be filled with fluid so that it contains about 20–30 percent of its total capacity. However, the optimum percentage, in any particular case, of fill of an inner tube cushion 13 having the foregoing dimensions and capacity is extremely variable and will depend, for example, upon such factors as the weight, body build and degree of distension of the abdomen of the individual user. The greatest advantage from the use of a mattress of the invention which incorporates such an inner tube as the cushion 13 will be achieved if the tube is filled with fluid to within the lower portion of the aforementioned volume range during the later stages of a pregnancy, and to within the higher portion of that range during earlier stages thereof. For example, a fill level of substantially 25 percent total volume capacity for a tube having the aforementioned dimensions and capacity may be considered a typical level for an average user about six months into the pregnancy term.
4. The resilient cushion 15 provides a headrest for the user. The cushion 15 can, similarly to the cushion 13, be of largely conventional, hollow construction and fluid-fillable, or of solid construction; when fluid-fillable, a user can fill it to a level which will provide a desired degree of comfort during use.
5. The upper layer 17 provides a protective covering for upper surfaces of the cushions 13 and 15 and, when made from absorbent cloth, can provide absorption of moisture during use.

As an example, in fabricating a prenatal mattress according to the invention, such as that illustrated in FIGS. 1 and 2 of the drawings, two elongated VELCRO ® strips will be spaced substantially parallel upon and then securely attached to, for example by gluing or sewing, the upper surface of a substantially rectangular sheet of absorbent cotton fabric forming a lower layer. All edges of the sheet will be coordinated with the edges of another cotton sheet of substantially the same shape and dimensions, and forming an upper layer. The edges of both sheets will then be stitched together a distance of approximately one-third of the length of their sides and along an adjacent end of each. Coordinating VELCRO® fasteners will then be securely attached, for example by gluing or sewing, to the inside edges of each sheet which have not been previously sewn.

Any suitable conventional materials and procedure will be used to fabricate the abdominal cushion of the mattress. For example, a conventional, substantially circular piece of heat-sealable, heavy-gauge rubber or plastic which has a circular center hole therein and which incorporates a conventional, two-way valve for sealing agains fluids will be placed in direct alignment over another such piece having substantially the same composition, shape and dimensions, but not having such a valve. The coordinated pieces will then be brought together and sealed permanently, around their outer edges and around their edges which form the outer circumference of the center holes, using a conventional heat-sealing process. Two strips of VELCRO® fastening material will then be attached securely, for example by gluing, to lower surfaces of the finished cushion, and spaced, one on each side of the center hole, so that the strips are substantially parallel to one another at a distance about equal to the distance between the elongated VELCRO® strips attached to the upper surface of the lower sheet.

Conventional materials and procedures will also be used to form the head cushion used in the mattress of the invention, for example as described in the foregoing paragraph. Two strips of VELCRO® fastening material will then be attached securely, for example by gluing, to the lower surface of the finished head cushion, and spaced so that they are substantially parallel to one another a distance about equal to the distance between the elongated VELCRO® strips on the upper surface of the bottom sheet.

It will be appreciated that various changes and modifications to the instant invention will be possible in addition to those described above, such as to the preferred embodiment of the invention described herein and illustrated in the drawings, for example:

(a) The releasable fasteners 18 on the lower surfaces of the cushions 13 and 15, those secured to the edges of the lower and upper layers 11 and 17, as indicated at 20, and the elongated fastening strips 12 on the lower layer 11 have been described as being made of VELCRO®, a type of hook-and-loop fastening material. However, other brands and types of conventional releasable fasteners could also be used, such as, for example, mechanical snaps, buttons or similar fasteners. In the case of fastening of the edges of the layers as at 20, a zipper can conveniently be used. A suitable hook-and-loop fastener is preferred for use in the present invention because of its simplicity, ease of use and relatively low cost, by comparison with other fastening materials.

(b) Both of the lower and upper layers 11 and 17 of the mattress 10 have been described as being composed of cloth, specifically cotton. It will be understood, however, that any other suitable material, for example nylon or various plastics, could be used as a material for such layers. Also a single layer of material, for example, covering only upper surfaces of the cushions 13 and 15, might be employed when the mattress 10 is used. If only a single, upper layer is used, the elongated fastening strips 12 would be situated upon the lower surfaces thereof, thereby to coordinate with the fasteners 18 on the cushions. In addition, one elongated sheet of material could be used in fabricating a mattress according to the invention, carrying VELCRO® strips which extend for substantially one-half of its longest dimension, the other one-half of the sheet being folded over to cover the cushions 13 and 15. However, two separate, lower and upper layers of cloth, for example as shown at 11 and 17, are preferred for use in a mattress of the invention over either of the variations described above. Utilizing a single covering layer would provide no protection for remaining exposed surfaces of the cushions used; moreover, an elongated, folded sheet would necessarily be somewhat awkward for a user to handle, and also decrease the portability of the mattress.

(c) Variations are possible in the manner in which the upper and lower layers of a mattress of the invention are joined together at their edges where a releasable fastening material is not to be used. In the foregoing description such edges of these layers 11 and 17 are described as being sewn, however, they could be heat-sealed, or sealed together in any suitable, conventional manner, so long as the layers are securely joined so that they cannot be readily taken apart.

It will be appreciated that numerous additional modifications can be made in the specific disclosure of the invention herein without departing from the spirit and scope thereof as defined in the following claims.

What I claim is:

1. A prenatal mattress for supporting the head, abdomen and other portions of the body of a pregnant user lying frontally downwardly thereupon, comprising:

(a) an upper layer comprising a longitudinally-extending sheet of flexible material having substantially upper and lower planar surfaces and opposed ends;

(b) a lower layer comprising a longitudinally-extending sheet of flexible material having substantially upper and lower planar surfaces and opposed ends, said lower layer being securely attached to said upper layer along one end of each of said layers;

(c) a first substantially ring-shaped resilient cushion, said first cushion having a substantially circular center hole and being disposed between said first and second layers in a suitable location for providing support for the abdomen of the user;

(d) a second resilient cushion disposed between said first and second layers and located in a substantially horizontal plane axially of said first cushion in a suitable location for providing support for the head of the user;

(e) releasable fastening means carried by a portion of the lower surface of said upper layer along adjacent edges thereof;

(f) releasable fastening means carried by a portion of the upper surface of said lower layer along adjacent edges thereof and located so as to be operable to releasably engage said fastening means carried by said upper layer when the lower surface of said upper layer is brought into contact with the upper surface of said lower layer, thereby to join said layers so that said cushions are disposed between said joined layers;

(g) additional releasable fastening means carried by the upper surface of said lower layer; and (h) releasable fastening means carried by each of said cushions and operable to releasably engage said additional fastening means carried by said lower layer, thereby to secure said cushions between said layers in their respective suitable locations.

2. The prenatal mattress according to claim 1, wherein said first cushion contains a fluid.

3. The prenatal mattress according to claim 1, wherein said second cushion contains a fluid.

4. The prenatal mattress according to claim 2 or 3, wherein said fluid is a gas.

5. The prenatal mattress according to claim 2 or 3, wherein said fluid is water.

6. The prenatal mattress according to claim 1, wherein each of said releasable fastening means comprises coordinating hook-and-loop fasteners.

7. The prenatal mattress according to claim 1, wherein the material of said upper and lower layers is moisture absorbent.

8. The prenatal mattress according to claim 7, wherein said absorbent material is cotton.

* * * * *